US006634181B2

(12) United States Patent
Kim et al.

(10) Patent No.: US 6,634,181 B2
(45) Date of Patent: Oct. 21, 2003

(54) COOLING AIR SUPPLY APPARATUS OF REFRIGERATOR

(75) Inventors: Sang Bae Kim, Changwon (KR); Young Seok Choi, Changwon (KR); Byung Gyu Kang, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/033,980

(22) Filed: Jan. 3, 2002

(65) Prior Publication Data

US 2003/0041615 A1 Mar. 6, 2003

(30) Foreign Application Priority Data

Aug. 31, 2001 (KR) ..... 2001-53409
Aug. 31, 2001 (KR) ..... 2001-53412
Aug. 31, 2001 (KR) ..... 2001-53416

(51) Int. Cl.[7] ..... F25D 17/04
(52) U.S. Cl. ..... 62/407; 62/408; 62/411
(58) Field of Search ..... 62/407, 408, 411, 62/414, 186, 187

(56) References Cited

U.S. PATENT DOCUMENTS 5,784,895 A * 7/1998 Choi ..... 62/407
5,822,998 A * 10/1998 Lim et al. ..... 62/408
5,921,104 A * 7/1999 Chang ..... 62/407
5,960,641 A * 10/1999 Kim et al. ..... 62/407
6,032,480 A * 3/2000 Kim ..... 62/408
6,044,654 A 4/2000 Igari et al. ..... 62/186
6,055,820 A * 5/2000 Jeong et al. ..... 62/408
6,058,723 A * 5/2000 Kusunoki et al. ..... 62/155
6,070,419 A * 6/2000 Chang ..... 62/408
6,138,460 A * 10/2000 Lee ..... 62/414
6,151,908 A * 11/2000 Graaff ..... 62/407
6,347,530 B1 * 2/2002 Kim ..... 62/407

FOREIGN PATENT DOCUMENTS

EP 0715137 A1 5/1996

* cited by examiner

*Primary Examiner*—William E. Tapolcai
*Assistant Examiner*—Mohammad M. Ali
(74) *Attorney, Agent, or Firm*—Fleshner & Kim, LLP

(57) ABSTRACT

A cooling air supply apparatus includes: a blowing fan attached at a rear wall face of a freezing chamber and forcefully circulating air cooled while passing an evaporator of a freezing cycle; a supply passage formed at a barrier partitioning the freezing chamber and a cooling chamber and supplying cooling air ventilated from the blowing fan to the cooling chamber; a rear guide passage branched from the cooling air passage and guiding cooling air backwardly of the cooling chamber; a right guide passage branched from the cooling air supply passage and guiding cooling air rightwardly of the cooling chamber; and a left guide passage branched from the cooling air supply passage, having the same diameter as that of the right guide passage and guiding cooling air leftwardly of the cooling chamber. Since a half of cooling air is guided from the supply passage to the rear guide passage and one-fourth of cooling air is respectively supplied to the right guide passage and the left guide passage, the cooling air distribution in the whole cooling chamber can be uniform. In addition, when a load occurs partially as food, or the like, is received into the freezing chamber, cooling air is concentratively discharged to the portion where the load occurs, so that a cooling operation can be quickly performed.

19 Claims, 10 Drawing Sheets

COOLING AIR SUPPLY APPARATUS OF REFRIGERATOR

BACKGROUND OF THE INVENTION

1. Field of the Invention

The present invention relates to a cooling air supply of a refrigerator, and more particularly, to a cooling air supply apparatus of a refrigerator that is capable of uniformly maintaining a cooling air distribution of a cooling chamber and capable of performing a concentrated cooling at a portion where a load is generated according to the load generated in the cooling chamber.

2. Description of the Background Art

In general, a refrigerator includes a freezing chamber for storing an ice tray for making ice and a frozen food and a cooling chamber for storing refrigerated items. The refrigerator also includes a cooling cycle for supplying cooling air to the freezing chamber and the cooling chamber.

In order to keep items in a fresh state for a long period of time, the internal temperature of the freezing chamber and the cooling chamber is necessarily maintained evenly. For this purpose, a method that a cooling air discharging hole is formed at a side wall and a rear face of the refrigerator, from which cooling air is discharged is mostly adopted.

FIG. 1 is a front view of a cooling air supply apparatus of a refrigerator in accordance with a conventional art, FIG. 2 is a sectional view taken along line A—A of FIG. 1, and FIG. 3 is a sectional view taken along line B—B of FIG. 2.

The conventional refrigerator includes a main body 102 having a certain space for storing items and a door 103 formed at an opened front side thereof so as to be opened and shut; a freezing chamber 104 formed at an upper side of the main body 102 and storing a frozen food; a cooling chamber 106 divided from the freezing chamber 104 by a barrier 108 and formed at a lower portion of the main body 102 for storing refrigerated items; a door 106 disposed at an opened front face of the main body 102 so as to be opened and shut; a freezing system (not shown) mounted inside the main body 102 and cooling air; and a cooling air supply apparatus supplying cooling air generated while passing the freezing cycle to the cooling chamber 106.

The cooling chamber 106 is formed at a lower portion of the main body 102 and a plurality of shelves 110 for receiving items are mounted in a horizontal direction therein. The cooling chamber includes a vegetable box 112 at its lower side.

The cooling air supply apparatus includes a blowing fan 116 disposed at a rear side of the cooling chamber 104 and circulating cooling air passing a evaporator 114 of the cooling cycle to the freezing chamber 104 and the cooling chamber 106; a shroud 118 having a discharge hole 120 for discharging the cooling air ventilated from the blowing fan 116 to the freezing chamber 104; a supply passage 122 formed at the barrier 108 and supplying the cooling air ventilated from the blowing fan 116 to the cooling chamber 106; a rear guide passage 124 branched from the supply passage 122 and guiding the cooling air backwardly of the cooling chamber 106; a right guide passage 126 branched from the supply passage 122 and guiding cooling air rightwardly of the cooling chamber 106; a left guide passage 128 branched from the rear guide passage 122 and guiding cooling air leftwardly of the cooling chamber 106; a rear discharge duct 130 communicating with the rear guide passage 124 and formed at a rear face of the cooling chamber 106 for discharging cooling air backwardly of the cooling chamber 106; a right discharge duct 132 communicating with the right guide passage and formed at a left face of the cooling chamber 106 for discharging cooling air rightwardly of the cooling chamber 106; and a left discharge duct 134 communicating with the left guide passage 128 and discharging cooling air leftwardly of the cooling chamber 105.

The cooling air supply passage 122 is formed at one rear side of the barrier 108 for receiving the cooling air from the blowing fan installed at the rear side of the freezing chamber 104, and supplies each half cooling air to the right guide passage 126 and the rear guide passage 124.

The left guide passage 128 is branched from the rear guide passage 124 and guide a portion of the cooling air supplied to the rear guide passage 124 to the left discharge duct 134.

The rear discharge duct 130, the right discharge duct 132 and the left discharge duct 134 respectively includes a plurality of discharge holes 140, 142 and 144 for discharging cooling air.

Suction passages 150 and 152 are formed at one side of the barrier 108 to suck cooling air which has completed cooling operation of the freezing chamber 104 and the cooling chamber 106 and sucked into the evaporator 114.

In the conventional cooling air supply apparatus, when the blowing fan 116 is driven, air cooled while passing the evaporator 114 of the freezing cycle is discharged to the freezing chamber 104 through the discharge hole 120 formed at the shroud 118 to perform a cooling operation of the freezing chamber, and then supplied to the cooling air supply passage 122.

Half of the cooling air supplied to the cooling air supply passage 122 is introduced into the right discharge duct 132 through the right guide passage 126 and the remaining half of the cooling air is introduced into the rear discharge duct 130 through the rear guide passage 124.

A portion of the cooling air introduced into the rear discharge duct 130 is supplied to the left discharge duct 134 through the left guide passage 128.

The cooling air supplied to each discharge duct is discharged from the rear left and right side of the cooling chamber 106 through the discharge holes 140, 142 and 144 formed at each discharge duct, thereby performing a cooling operation of the cooling chamber 106.

After completing the cooling operation while circulating the cooling chamber 106 and the freezing chamber 104, the cooling air is introduced into the evaporator 114 through the cooling air inflow passages 150 and 452.

However, the conventional cooling air supply apparatus of a refrigerator has the following problems.

That is, since the cooling air supply passage and the rear and right guide passages are connected and the right guide passage is connected to the rear guide passage, the cooling air supplied from the cooling air supply passage is divided to be supplied to the right guide passage and the rear guide passage, and the cooling air supplied to the rear guide passage is again divided to be supplied to the left guide passage, resulting in that the amount of cooling air discharged from the right discharge duct and the amount of cooling air discharged from the rear and the left guide passages differ.

In other words, since the amount of cooling air discharged from the three sides of the cooling chamber differ each other, the temperature distribution of the cooling chamber is uneven according to the deviation of the amount of cooling air.

In addition, when a load is generated at a certain portion of the cooling chamber as a foodstuff is received therein, since a uniform cooling air is constantly discharged through each discharge hole, it takes long time to make the temperature distribution of the cooling chamber even.

SUMMARY OF THE INVENTION

Therefore, an object of the present invention is to provide a cooling air supply apparatus of a refrigerator that is capable of making the amount of cooling air discharged from three sides of a cooling chamber by evenly distributing cooling air through a plurality of guide passages guiding cooling air from a cooling air supply passage to three sides of a cooling chamber.

Another object of the present invention is to provide a cooling air supply apparatus that is capable of performing a rapid cooling operation and maintaining a temperature distribution of a cooling chamber to be even by concentratively discharging cooling air to a portion where a load occurs when the load partially occurs as a foodstuff is received into the cooling chamber.

Still another object of the present invention is to provide a cooling air supply apparatus of a refrigerator that is capable of controlling an amount of cooling air being supplied according to a position of a cooling chamber and thus increasing an overall efficiency of a refrigerator.

To achieve these and other advantages and in accordance with the purpose of the present invention, as embodied and broadly described herein, there is provided a cooling air supply apparatus including: a blowing fan attached at a rear wall face of a freezing chamber and forcefully circulating air cooled while passing an evaporator of a freezing cycle; a supply passage formed at a barrier partitioning the freezing chamber and a cooling chamber and supplying cooling air ventilated from the blowing fan to the cooling chamber; a rear guide passage branched from the cooling air passage and guiding cooling air backwardly of the cooling chamber; a right guide passage branched from the cooling air supply passage and guiding cooling air rightwardly of the cooling chamber; and a left guide passage branched from the cooling air supply passage, having the same diameter as that of the right guide passage and guiding cooling air leftwardly of the cooling chamber.

In the cooling air supply apparatus of a refrigerator of the present invention, the rear guide passage is formed at one side of the barrier in a horizontal direction and a half of the cooling air supplied from the supply passage is guided to the rear discharge duct.

In the cooling air supply apparatus of a refrigerator of the present invention, the right guide passage is formed at a right side of the barrier in a vertical direction and guides one-fourth of the cooling air supplied from the supply passage to the right discharge duct.

In the cooling air supply apparatus of a refrigerator of the present invention, the left guide passage is formed at the barrier to have a certain slant angle and guides one-fourth of the cooling air supplied from the supply passage to the left discharge duct.

To achieve the above objects, there is also provided a cooling air supply apparatus of a refrigerator including: a blowing fan forcefully blowing cooling air to a freezing chamber and a cooling chamber; a supply passage formed at a barrier partitioning the freezing chamber and the cooling chamber and supplying cooling air ventilated by the blowing fan to the cooling chamber; a rear guide passage guiding cooling air supplied to supply passage to a rear cooling air duct formed at a rear face of the cooling chamber; a left guide passage guiding cooling air supplied to the cooling air supply passage to a left cooling air duct formed at left side of the cooling chamber; a right guide passage guiding cooling air supplied to the cooling air supply passage to a right cooling air duct formed at right side of the cooling chamber; and a controller installed at one side of the rear guide passage and opening and closing the rear guide passage as a refrigerator door is opened and shut.

In the cooling air supply apparatus of a refrigerator of the present invention, the controller includes: an open-and-shut valve rotatably mounted at one side of the rear guide passage and opening and closing the rear guide passage; a sensing unit installed at one side of the cooling chamber and detecting whether the refrigerator door is opened or shut; and a control unit operating the open-and-shut valve to shut the rear guide passage for a predetermined time period according to an electric signal applied from the sensing unit.

In the cooling air supply apparatus of a refrigerator of the present invention, the open-and-shut valve includes a disk-type valve plate rotatably mounted at one side of the rear guide passage and having the same diameter as the inner diameter of the rear guide passage; and a stepping motor connected to a rotational shaft of the valve plate and rotating the valve plate according to an electric signal of the controller.

In the cooling air supply apparatus of a refrigerator of the present invention, the sensing unit is installed as a switch at an opening side of the cooling chamber where the cooling chamber door is mounted so that when the cooling chamber door is opened, the sensing unit transmits an electric signal to the controller, while if the cooling chamber door is shut, a power is cut off.

In the cooling air supply apparatus of a refrigerator of the present invention, the controlling unit includes a timer for delaying for a predetermined time period a working time of the open-and-shut valve when the electric signal is applied thereto from the sensing unit.

To achieve the above objects, there is also provided a cooling air supply apparatus of a refrigerator including: a blowing fan forcefully circulating cooling air which has passed a freezing cycle to a cooling chamber and a freezing chamber; a barrier partitioning the cooling chamber and the freezing chamber; a supply passage formed at the barrier and supplying cooling air ventilated by the blowing fan to the cooling chamber; a rear guide passage branched from the supply passage and guiding cooling air backwardly of the cooling chamber; left and right guide passages branched rightwardly and leftwardly from the supply passage and guiding cooling air leftwardly and rightwardly of the cooling chamber; and a cooling air controlling unit for selectively opening and shutting the rear, left and right guide passages and concentratively discharging cooling air to a portion where a load occurs as the load occurs at the portion of the cooling chamber.

In the cooling air supply apparatus of a refrigerator of the present invention, the cooling air controlling unit includes: a sensing unit detecting a temperature of each portion inside the cooling chamber; a first valve installed at the rear guide passage to open and shut the rear guide passage; a second valve installed at a point where right and left guide passages are branched and selectively opening right and left guide passage; and a control unit operating the first and the second valve according to an electric signal applied from the sensing unit.

In the cooling air supply apparatus of a refrigerator of the present invention, the sensing unit includes a first temperature sensor installed at a rear side of the cooling chamber; a second temperature sensor installed at a left side of the cooling chamber door and detecting a temperature of the left side of the cooling chamber; and a third temperature sensor installed at a right side of the cooling chamber door and detecting a temperature of the right side of the cooling chamber.

In the cooling air supply apparatus of a refrigerator of the present invention, the first valve includes a valve plate formed having the same diameter as that of the rear guide passage and rotatably mounted at one side of the rear guide passage; and a stepping motor connected to a hinge shaft of the valve plate and rotating the valve plate.

In the cooling air supply apparatus of a refrigerator of the present invention, the second valve includes a valve plate rotatably installed at a point where the supply passage is branched to the right guide passage and the left guide passage and being operated in three directions, and a stepping motor installed at a hinge shaft of the valve plate and operating the valve plate in the three directions.

In the cooling air supply apparatus of a refrigerator of the present invention, the valve plate is formed as a disk type.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments of a cooling air supply apparatus of a refrigerator of the present invention, and the most preferred one will now be described.

Figure 1:
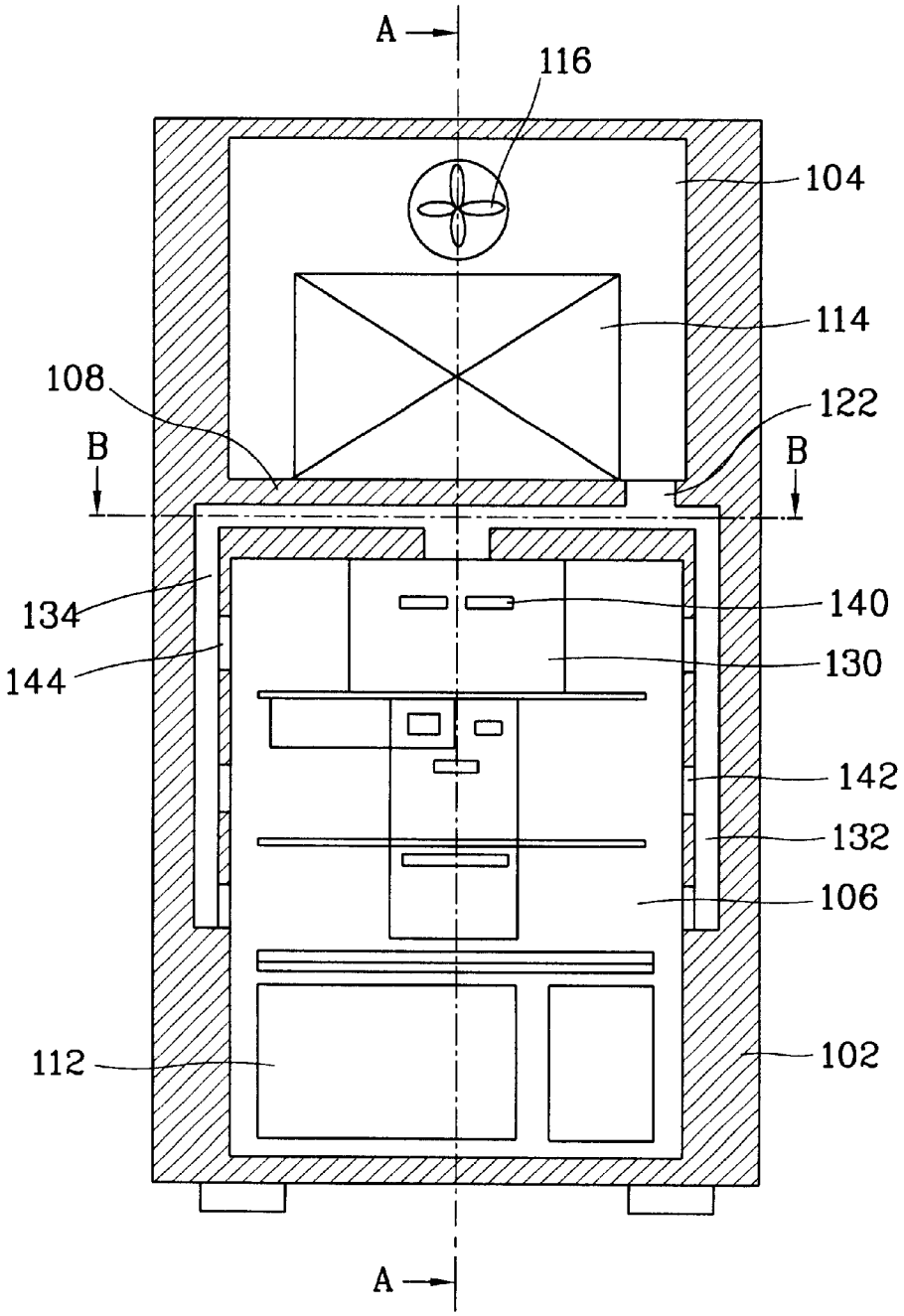
FIG. 1 BACKGROUND ART
FIG. 1 is a vertical-sectional view showing a cooling air supply apparatus of a refrigerator in accordance with a conventional art.
Figure 2:
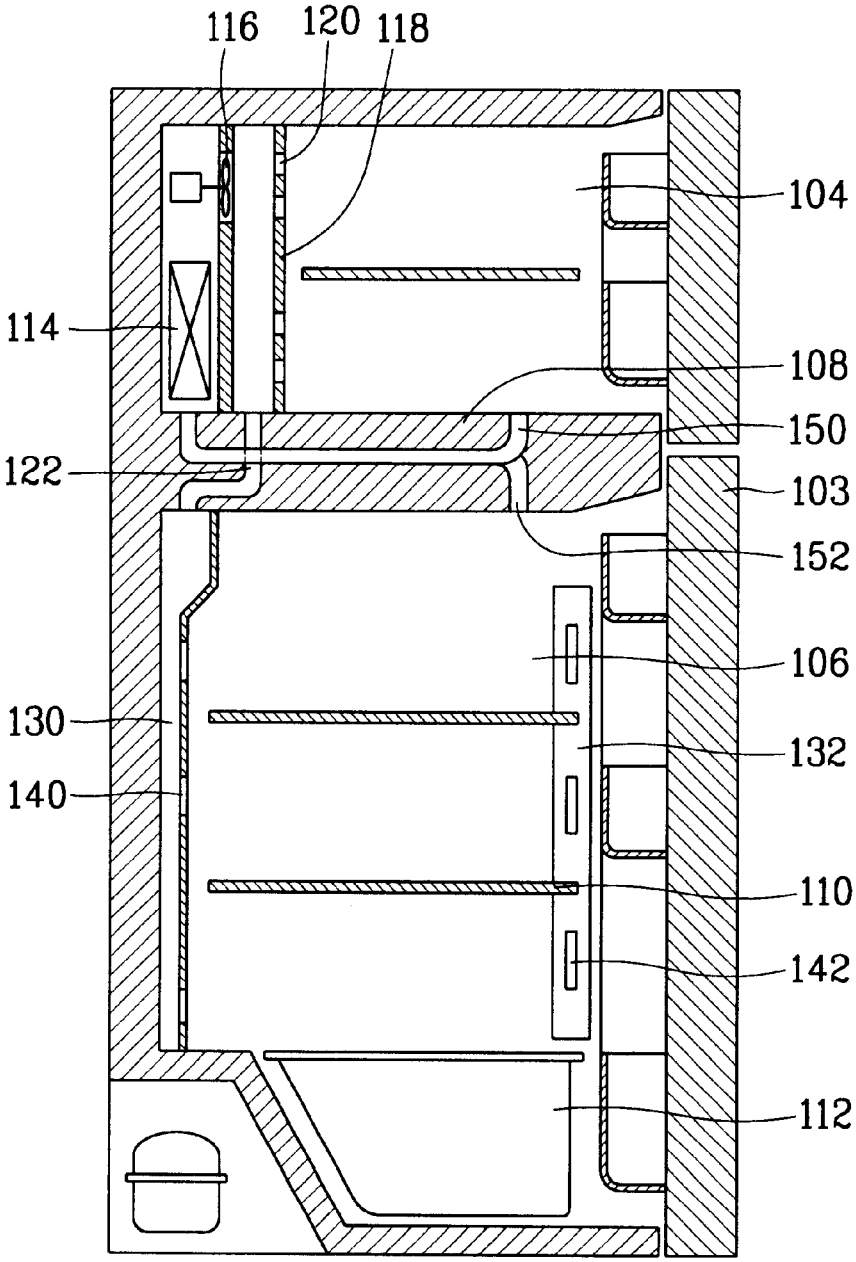
FIG. 2 BACKGROUND ART
FIG. 2 is a sectional view taken along line A—A of FIG. 1 showing a cooling air supply apparatus of a refrigerator in accordance with the conventional art.
Figure 3:
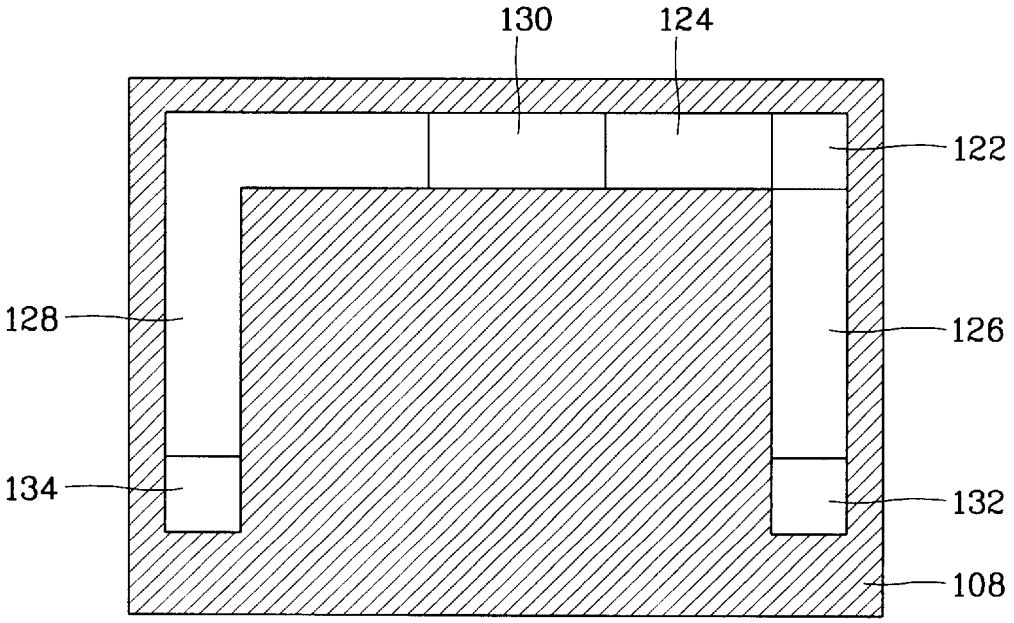
FIG. 3 BACKGROUND ART
FIG. 3 is a sectional view taken along line B—B of FIG. 1 showing the cooling air supply apparatus of a refrigerator in accordance with the conventional art.
Figure 4:
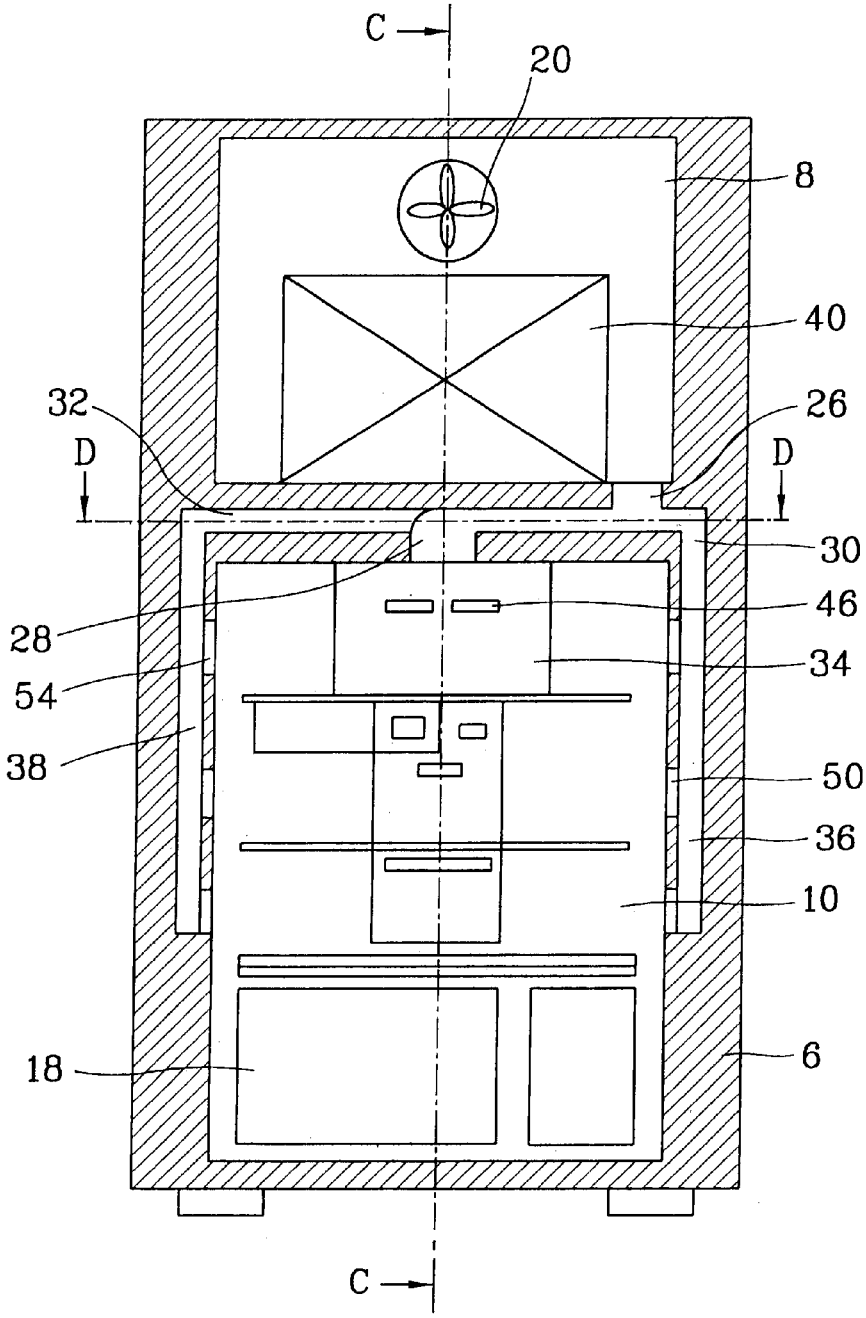
FIG. 4 is a vertical-sectional view showing a cooling air supply apparatus of a refrigerator in accordance with a preferred embodiment of the present invention.
Figure 5:
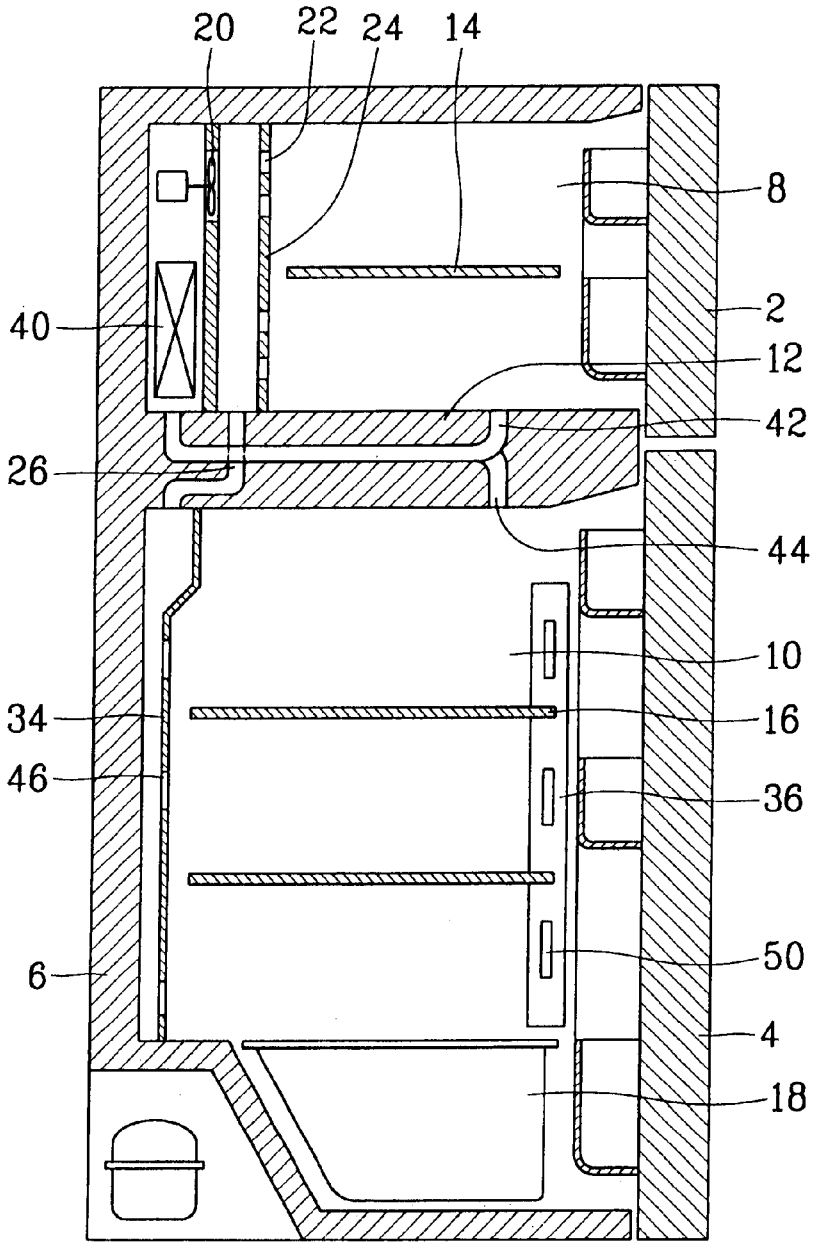
FIG. 5 is a sectional view taken along line C—C of FIG. 4 showing the cooling air supply apparatus of a refrigerator in accordance with the preferred embodiment of the present invention.

FIG. 4 is a vertical-sectional view showing a cooling air supply apparatus of a refrigerator in accordance with a preferred embodiment of the present invention, and FIG. 5 is a sectional view taken along line C—C of FIG. 4 showing the cooling air supply apparatus of a refrigerator in accordance with the preferred embodiment of the present invention.

A refrigerator of the present invention includes a main body 6 having a freezing chamber door 2 and a cooling chamber door 4 formed at a front side opened with a certain space for storing items; a freezing chamber 8 formed at an upper portion of the main body 6 and storing frozen food; a cooling chamber 10 formed at a lower portion of the main body 6 and storing refrigerated items; a barrier 12 formed at the main body 6 in a horizontal direction to partition the freezing chamber 8 and the cooling chamber 10; a freezing system (not shown) installed inside the main body 6 and cooling air; and a cooling air supply apparatus supplying cooling air generated while passing the freezing cycle to the freezing chamber 8 and the cooling chamber 10.

Shelves 14 and 16 are installed in the freezing chamber and the cooling chamber 10 at regular intervals, and a vegetable box 18 for storing vegetables is installed at a lower side of the cooling chamber 10.

The cooling air supply apparatus includes: a blowing fan 20 attached at a rear wall face of the freezing chamber 6 and forcefully circulating air cooled while passing an evaporator of the freezing cycle; a shroud 24 having a discharge hole 22 discharging the cooling air ventilated by the blowing fan 20 to the freezing chamber 8; a supply passage 26 communicating with a lower side of the shroud 24 and formed at the barrier 12 to supply cooling air to the cooling chamber 10; a plurality of guide passages 28, 30 and 32 branched from the supply passage 26 to guide cooling air to the three sides of the cooling chamber 10; and a plurality of discharge ducts 34, 36 and 38 connected to the guide passages 28, 30 and 32 and discharging cooling air from the three faces of the cooling chamber.

Cooling air suction holes 42 and 44 are formed at one side of the barrier 12, through which cooling air is introduced to the evaporator 40 of the cooling cycle after completing a cooling operation of the freezing chamber 8 and the cooling chamber.

The discharge duct includes a rear discharge duct 34 having a plurality of discharge holes 46 formed at a rear side wall of the cooling chamber 10 and discharging cooling air from the rear side of the cooling chamber; a right discharge duct 36 having a plurality of discharge holes 50 formed in a vertical direction at a right face of the cooling chamber 10 and discharging cooling air; and a left discharge duct 38 having a plurality of discharge holes 54 formed at a left face of the cooling chamber in a vertical direction and discharging cooling air from the left side of the cooling chamber.

Figure 6:
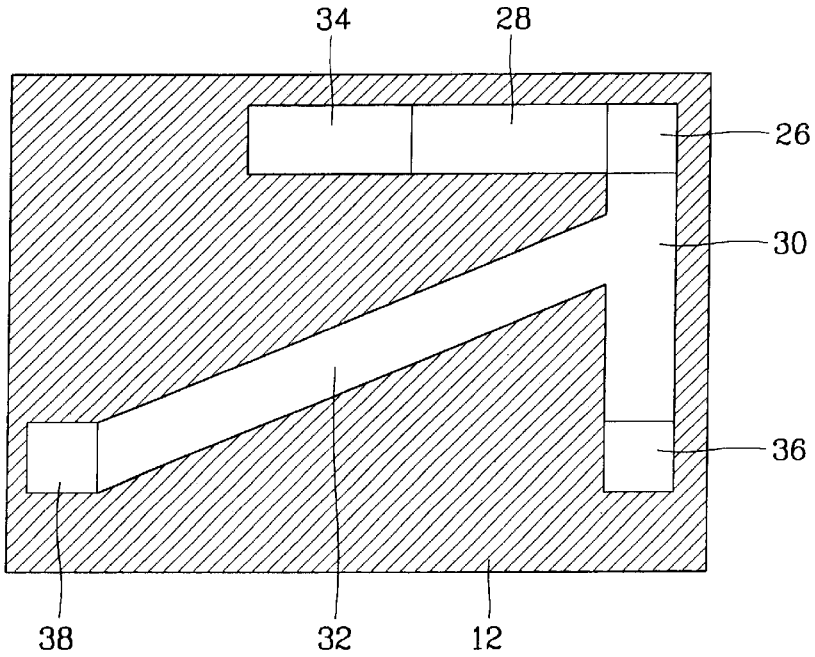
FIG. 6 is a sectional view taken along line D—D of FIG. 4 showing the cooling air supply apparatus of a refrigerator in accordance with the preferred embodiment of the present invention.

As shown in FIG. 6, the guide passage 28 is branched from the supply passage 26 and guides cooling air backwardly of the cooling chamber 10. The left guide passage 32 and the right guide passage 30 are respectively branched from the supply passage 26 and guide cooling air leftwardly and rightwardly of the cooling chamber 10.

In detail, the rear guide passage 28 is formed in a horizontal direction at one side of the barrier 12 and branched from the supply passage 26 so as to guide a half of the cooling air supplied to the supply passage 26 to the rear discharge duct 34.

The right guide passage 30 is formed in a vertical direction at a right portion of the barrier 12 and branched from the supply passage 26 so as to guide one-fourth the cooling air supplied to the supply passage to the right discharge duct 36.

The left guide passage 32 is branched from the supply passage 26, having the same diameter as that of the right guide passage, and formed slantingly at one side of the barrier 12, so as to guide one-fourth the cooling air supplied to the supply passage 26 to the left discharge duct 38.

That is, since the right and left guide passages 30 and 32 are branched in the two directions from the supply passage and have the same diameter to each other, the same amount of cooling air is discharged from the left side and right side of the cooling chamber 10.

The operation of the cooling air supply apparatus constructed as described above will now be explained.

When the freezing cycle and the blowing fan 20 are driven, air cooled while passing the evaporator 40 of the freezing cycle is discharged to the freezing chamber 8 through the discharge hole 22 formed at the shroud 24, so as to perform a cooling operation while circulating the freezing chamber 8, and as the cooling air completes the cooling operation, it is introduced into the evaporator 40 of the cooling cycle through the cooling air suction hole 42.

The cooling air supplied from the blowing fan 20 to the supply passage 26 is supplied to the cooling chamber through the guide passage. That is, a half of the cooling air supplied from the supply passage 26 is introduced into the rear guide passage 28 and discharged backwardly of the cooling chamber 10 through the discharge hole 46 of the rear discharge duct 34, one-fourth the cooling air supplied to the supply passage is introduced into the left guide passage 32 and discharged leftwardly of the cooling chamber through the discharge hole 46 of the left discharge duct, and remaining one-fourth of the cooling air is introduced into the right guide passage 30 and discharged rightwardly of the cooling chamber 10 through the discharge hole 50 of the right discharge duct.

In this manner, the same amount of cooling air is discharged from the left discharge duct 32 and the right discharge duct 30 of the cooling chamber, so that the temperature distribution in the cooling chamber can be uniformly maintained.

Figure 7:
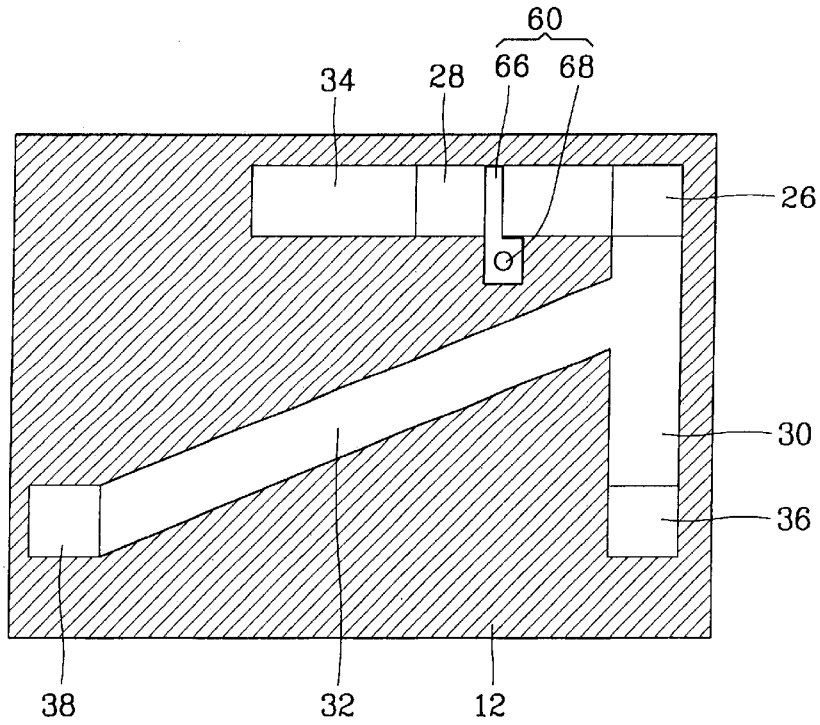
FIG. 7 is a sectional view showing a cooling air supply apparatus of a refrigerator in accordance with a second embodiment of the present invention.
Figure 8:
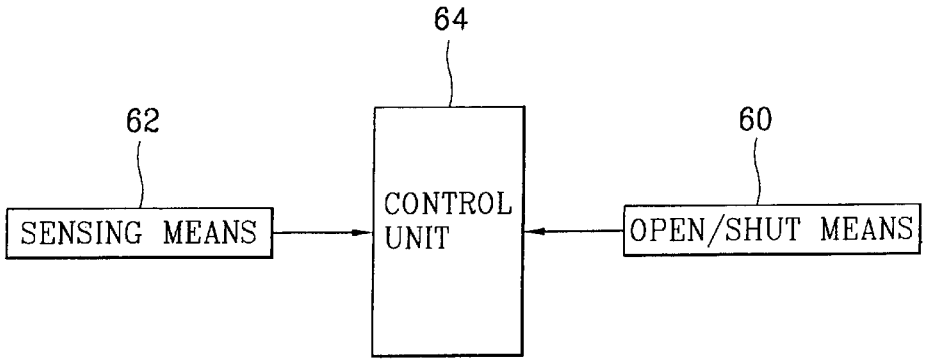
FIG. 8 is a schematic block diagram showing a controlling unit of the cooling air supply apparatus of a refrigerator in accordance with the second embodiment of the present invention.

FIG. 7 is a sectional view showing a cooling air supply apparatus of a refrigerator in accordance with a second embodiment of the present invention, and FIG. 8 is a schematic block diagram showing a controlling unit of the cooling air supply apparatus of a refrigerator in accordance with the second embodiment of the present invention.

A cooling air supply apparatus in accordance with the second embodiment of the present invention has the same structure as that of the cooling air supply apparatus of the first embodiment of the present invention and is featured in that a cooling air controlling unit is installed to control an amount of cooling air supplied from a cooling air supply passage to a cooling air guide passage.

The cooling air supply apparatus in accordance with the second embodiment of the present invention will now be described with reference to FIGS. 4 and 7.

As shown in FIGS. 4 and 7, the cooling air supply apparatus in accordance with the second embodiment of the present invention includes a blowing fan 20 blowing cooling air to a freezing chamber 8 and a cooling chamber 10; a supply passage 26 supplying cooling air ventilated by the blowing fan 20 to the cooling chamber 10, a rear guide passage 28 guiding cooling air supplied to the supply passage 26 to a rear discharge duct 34 formed at a rear face of the cooling chamber 10; a left guide passage 32 guiding cooling air supplied to the supply passage to a left discharge duct 38 formed at left side of the cooling chamber 10; a right guide passage 30 guiding cooling air supplied to the supply passage 26 to a right discharge duct 36 formed at a right side of the cooling chamber 10; and a controlling unit installed at one side of the rear guide passage 28 and opening and closing the rear guide passage 28 as a cooling chamber door 4 is opened and shut.

A half of the cooling air supplied from the supply passage 26 is introduced into the rear guide passage 28, and one-fourth of the cooling air is distributed to the right and left guide passage 30 and 32.

As shown in FIG. 8, the controlling unit includes an open-and-shut unit 60 rotatably mounted at one side of the rear guide passage 28 and opening and shutting the rear guide passage 28, a sensing unit 62 detecting whether the cooling chamber door is opened or shut; and a control unit 64 driving the open-and-shut unit 60 according to an electric signal applied from the sensing unit 62.

The open-and-shut unit 60 includes a valve plate 66 formed as a disk type having the same diameter as that of the rear guide passage 28 and rotatably mounted at one side of the rear guide passage 28, and a stepping motor 68 connected to a rotational shaft of the valve plate 66 and rotating the valve plate 66.

The sensing unit 62 is preferably formed as a switch type and installed at an opened front side of the cooling chamber 10 so that, when the cooling chamber door 4 is opened, the sensing unit is turned on, and when the cooling chamber door 4 is shut, the sensing unit is turned off and applies an electric signal to the control unit 64.

As for the sensing unit 62, any type of unit can be adopted as the sensing unit so long as it can detect whether the cooling chamber door 4 is opened or shut.

The control unit 64 preferably includes a timer which is able to turn off the open-and-shut valve when a predetermined time elapses after the open-and-shut unit 60 is operated.

The operation of the cooling air supply apparatus in accordance with the second embodiment of the present invention constructed as described above will now be explained.

As shown in FIG. 7, in a state that the cooling chamber door 4 is shut, the open-and-shut unit 60 is operated to open the rear guide passage 28.

That is, when cooling air is supplied to the supply passage 26, a half of the cooling air is introduced into the rear discharge duct 34 through the rear guide passage 28 and discharged backwardly of the cooling chamber, and the remaining half of the cooling air is distributed to the right and left guide passages 30 and 32, introduced into the right and left discharge ducts 36 and 38 and discharged from the right and left side of the cooling chamber 10.

Figure 9:
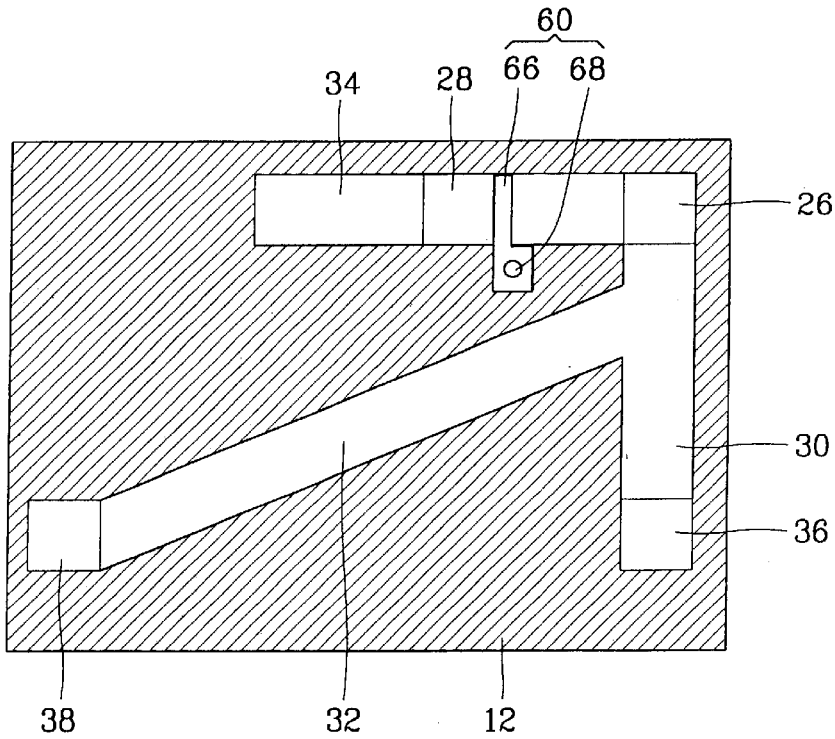
FIG. 9 is a view showing a use state of the cooling air supply apparatus of a refrigerator in accordance with the second embodiment of the present invention.

FIG. 9 is a view showing a use state of the cooling air supply apparatus of a refrigerator in accordance with the second embodiment of the present invention.

As shown in FIG. 9, when the cooling chamber door 4 is opened during the cooling operation, the sensing unit 52 detects the opened state of the cooling chamber 10 and applies a corresponding electric signal to the control unit 64. Then, the control unit 64 determines that the cooling chamber door 4 has been opened and operates the stepping motor 68. And then, the valve plate 66 is rotated to shut the rear guide passage 28, thereby preventing cooling air from being introduced into the rear discharge duct 34.

Accordingly, the cooling air supplied to the supply passage 26 is distributed by each ½ to the right and left guide passages 30 and 32, and discharged from the left and right side of the cooling chamber 10 through the right and left discharge ducts 36 and 38.

After the valve plate 66 is operated to shut the rear guide passage 28, when a predetermined time elapses, the control unit 64 cuts off a power being applied to the stepping motor 68 to render the valve plate 66 to be operated to open the guide passage 28, so that cooling air can be discharged from the rear side of the cooling chamber 10.

In this manner, when the cooling chamber door 4 is opened, since the cooling air is concentratively discharged from the right and left discharge ducts 36 and 38 toward the cooling chamber door 4, items stored in the vicinity of the cooling chamber door 4 can be quickly cooled, and even though the cooling chamber door 4 is frequently opened and shut, a temperature increase in the cooling chamber can be prevented.

In addition, for a concentrative cooling, an additional power consumption is not used and the cooling air discharged backwardly is concentrated to the right and left side, so that an efficiency of the freezing system can be much improved.

Figure 10:
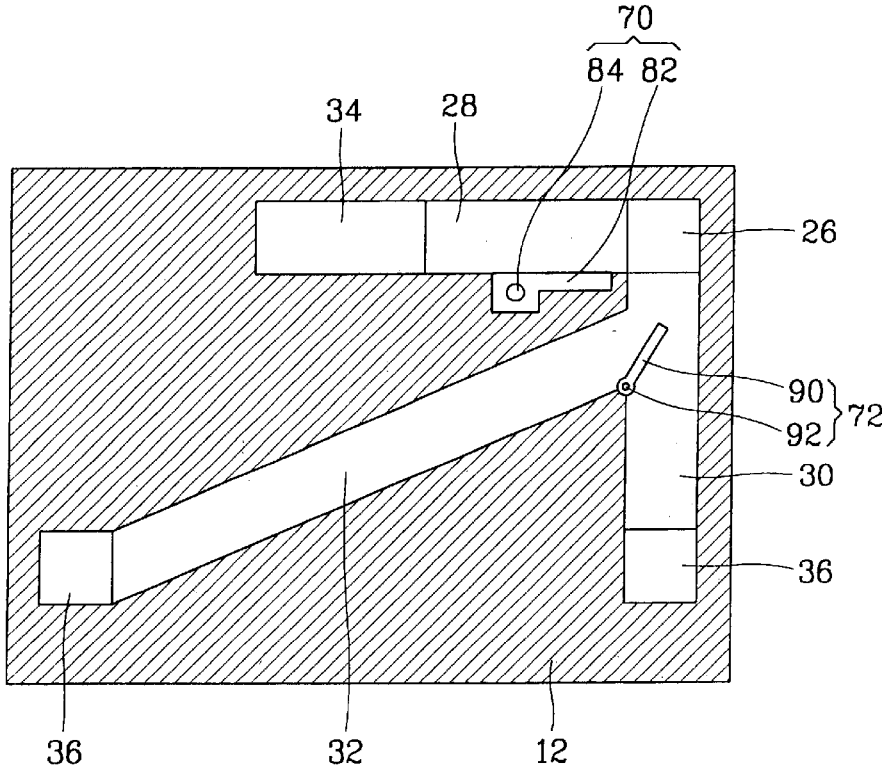
FIG. 10 is a sectional view showing a cooling air supply apparatus of a refrigerator in accordance with a third embodiment of the present invention.

FIG. 10 is a sectional view showing a cooling air supply apparatus of a refrigerator in accordance with a third embodiment of the present invention.

With reference to FIGS. 4 an 10, a cooling air supply apparatus in accordance with a third embodiment of the present invention includes a blowing fan 20 forcefully circulating cooling air which has passed a freezing cycle to a freezing chamber 8 and a cooling chamber 10; a barrier 12 partitioning the freezing chamber 8 and the cooling chamber 10; a supply passage 26 formed at the barrier 12 and supplying cooling air ventilated by the blowing fan 20 to the cooling chamber 10, a rear guide passage 28 branched from the supply passage 26 and guiding cooling air backwardly of the cooling chamber 10, a right and left guide passages 30 and 32 branched from the supply passage 26 and guiding cooling air rightwardly and leftwardly of the cooling chamber 10, and a cooling air controlling unit for opening and shutting a passage of cooling air supplied in the three directions of the cooling chamber 10 and concentratively discharging cooling air to one portion of the cooling chamber 10.

Figure 11:
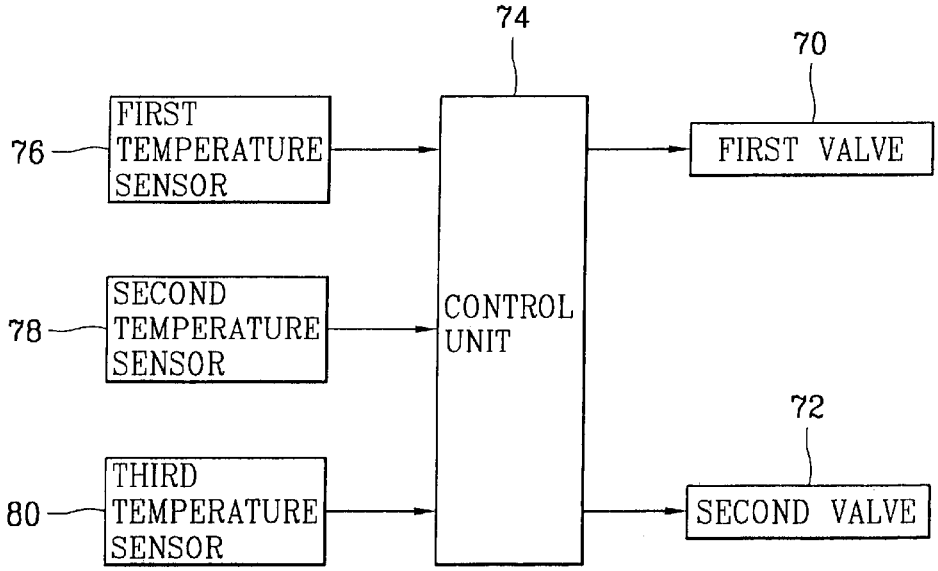
FIG. 11 is a schematic block diagram showing a cooling air controlling unit of the cooling air supply apparatus in accordance with the third embodiment of the present invention.

FIG. 11 is a schematic block diagram showing a cooling air controlling unit of the cooling air supply apparatus in accordance with the third embodiment of the present invention.

As shown in FIG. 11, the cooling air controlling unit includes a sensing unit detecting a temperature of each portion inside the cooling chamber 10, a first valve 70 installed at the rear guide passage 28 so as to open and shut the rear guide passage 28, a second valve 72 installed at a point where the right and left guide passages 30 and 32 are branched and selectively opening the right and left guide passages 30 and 32, and a control unit 74 operating the first and the second valves 70 and 72 according to an electric signal applied from the sensing unit.

Figure 12:
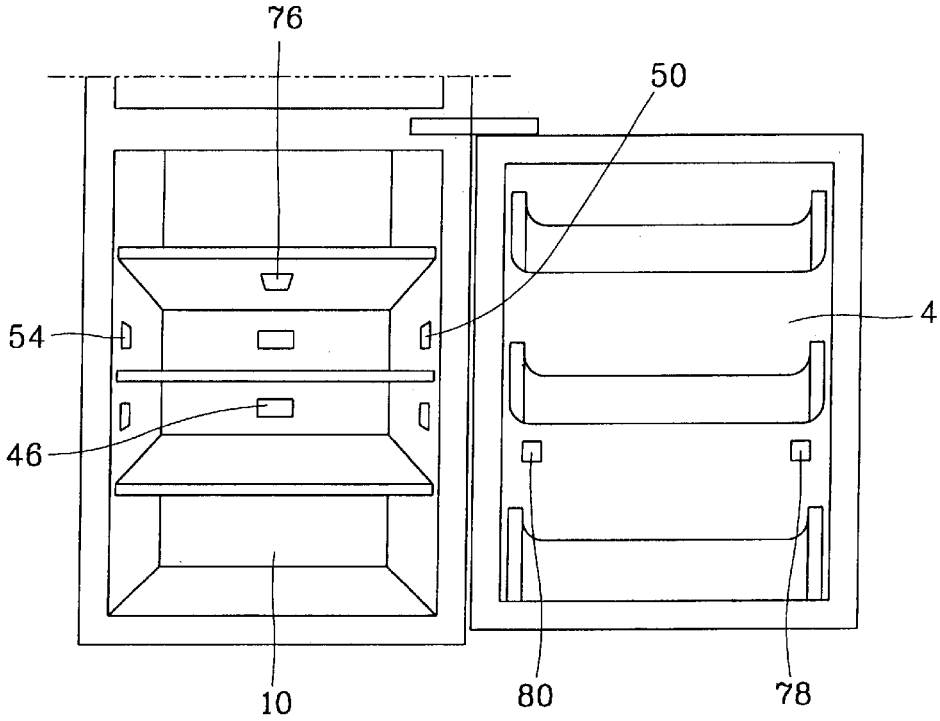
FIG. 12 is a front view showing a state that a cooling chamber door is opened and where a sensing unit of the cooling air supply apparatus of a refrigerator is mounted in accordance with the third embodiment of the present invention.

FIG. 12 is a front view showing a state that a cooling chamber door is opened and where a sensing unit of the cooling air supply apparatus of a refrigerator is mounted in accordance with the third embodiment of the present invention.

As shown in FIG. 12, the sensing unit includes a first temperature sensor 76 installed at a rear portion of the cooling chamber 10 and detecting a temperature of the rear portion of the cooling chamber 10; a second temperature sensor 78 installed at a left portion of the cooling chamber door 4 and detecting a temperature of the left portion, and a third temperature sensor 80 installed at a right portion of the cooling chamber door 4 and detecting a temperature of the right portion of the cooling chamber.

The first valve 70 includes a valve plate 82 formed as a disk type having the same diameter as that of the rear guide passage 28 and rotatably mounted at one side of the rear guide passage 28, and a stepping motor 84 connected to a rotational shaft of the valve plate 82 and rotating the valve plate 82.

Referring to the first valve 70, when a power is applied from the control unit 74 to the stepping motor 84, the valve plate 82 is operated to shut the rear guide passage 28, while when a power of the stepping motor 84 is cut off, the valve plate 82 is returned to open the rear guide passage 28.

The second valve 72 includes a valve plate 82 rotatably installed at a point where the supply passage 26 is branched to the right guide passage 30 and the left guide passage 32 and being operated in the three directions, and a stepping motor 92 installed at a hinge shaft of the valve plate 82 and operating the valve plate 82 in the three directions.

The second valve 72 is operated to a first position for opening both the right guide passage 30 and the left guide passage 32 in order to supply cooling air from the supply passage 26 to the right guide passage 30 and the left guide passage 32, to a second position for closing the right guide passage 30 to supply cooling air to the left guide passage 32, and to a third position for closing the left guide passage 32 to supply cooling air to the right guide passage 30.

The cooling air supply apparatus in accordance with the third embodiment of the present invention constructed as described above will now be explained.

Figure 13:
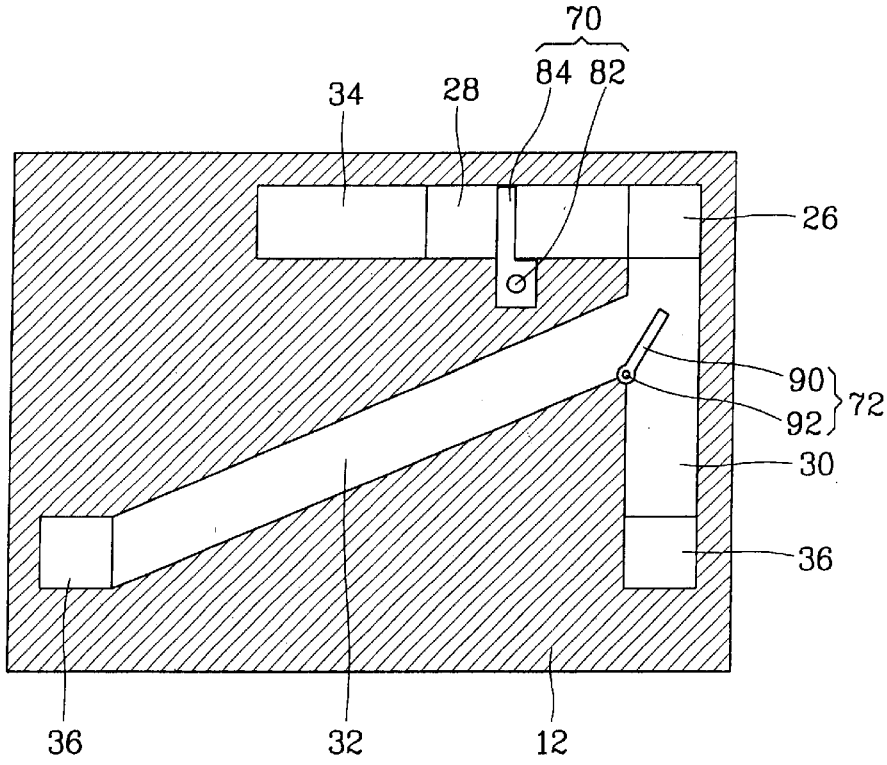
FIGS. 13 through 15 are views showing operational states of the cooling air supply apparatus of a refrigerator in accordance with the third embodiment of the present invention.
Figure 14:
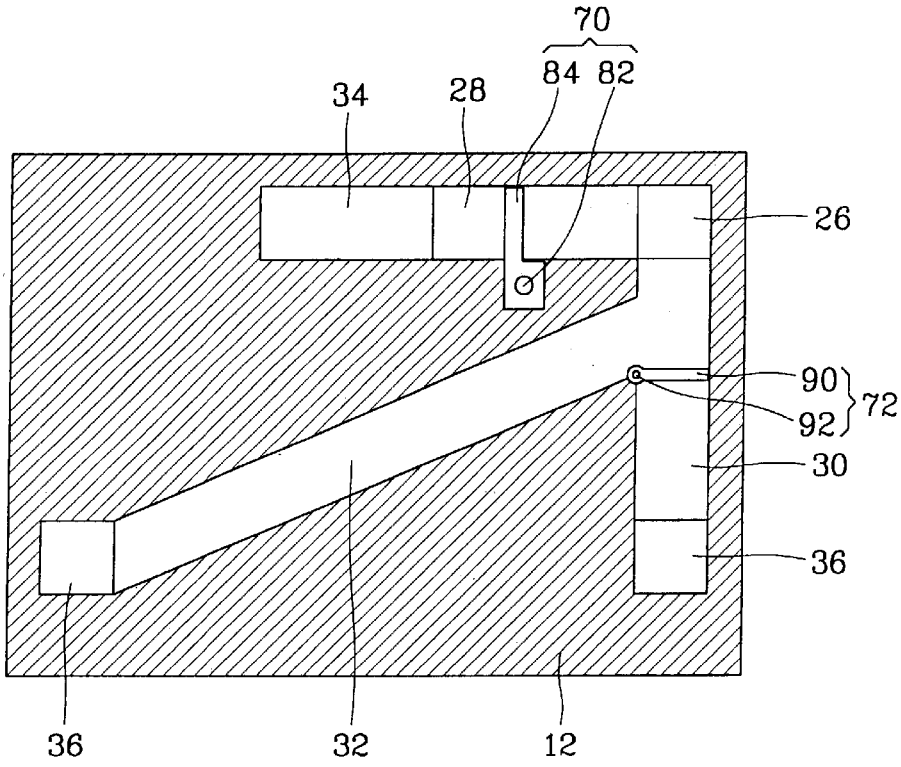
Figure 15:
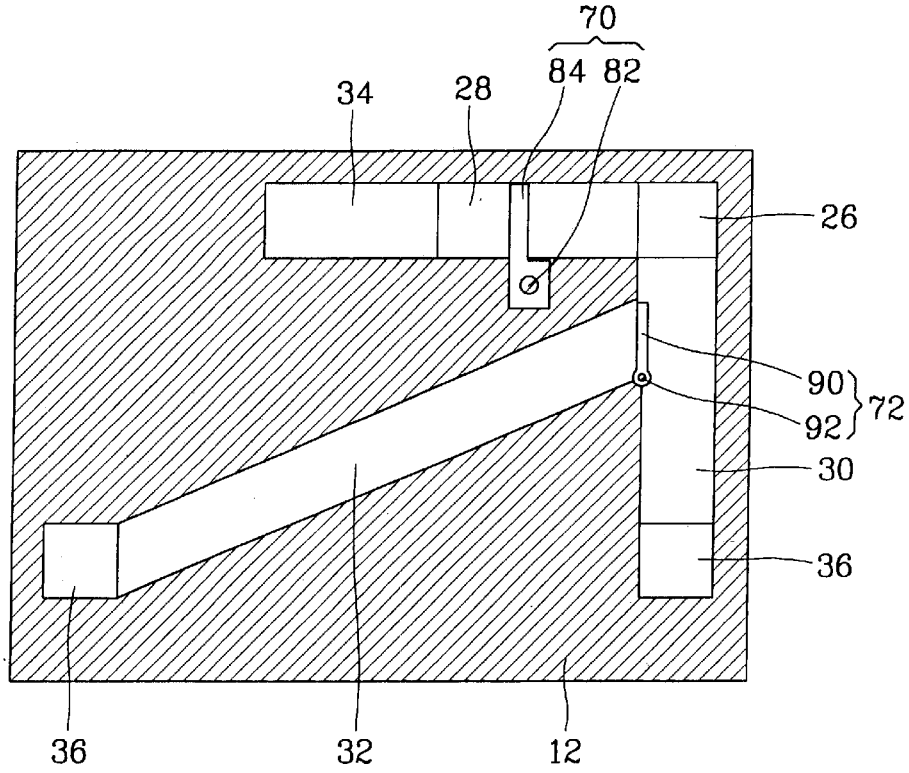

FIGS. 13 through 15 are views showing operational states of the cooling air supply apparatus of a refrigerator in accordance with the third embodiment of the present invention.

First, as shown in FIG. 10, the first valve 70 is operated to open the rear guide passage 28, and the second valve 72 is operated to the first position to open both the right and left guide passages 30 and 32.

Namely, cooling air supplied from the supply passage 26 is supplied to the rear discharge duct 34 through the rear guide passage 28 so that cooling air can be discharged, cooling air supplied to the left discharge duct 38 through the left guide passage 32 so that cooling air can be discharged from the left side of the cooling chamber 10, and cooling air is supplied to the right discharge duct 36 through the right guide passage 30 so that cooling air can be discharged from the right side of the cooling chamber, thereby performing a cooling operation of the cooling chamber.

During the normal operation, when the temperature in the vicinity of the cooling chamber door 4 as the cooling chamber door 4 is opened, or the like, as shown in FIG. 4, an electric signal is applied from the second and third temperature sensors 78 and 80 to the control unit 74. Then, the control unit 74 drives the stepping motor 84 of the first valve and operates the valve plate 82 to shut the rear guide passage 28.

Then, as the rear guide passage 28 is shut, the cooling air is guided to the right discharge duct 36 and the left discharge duct 38 through the right and left guide passages 30 and 32, so that the cooling air is concentratively discharged from the right and left side of the cooling chamber to quickly drop the temperature in the vicinity of the cooling chamber door 4, and thus the temperature of the whole cooling chamber can be uniformed.

When the temperature increases as a load occurs at a left side of the cooling chamber 10, as shown in FIG. 14, the control unit 74 determines that the temperature at the left side of the cooling chamber 10 has gone up according to an electric signal applied from the first, second and third temperature sensors 76, 78 and 8, so that the first valve 70 is operated to shut the rear guide passage 28 and the second valve 72 is operated to the second position to shut the right guide passage 30.

Then, cooling air being supplied to the supply passage 26 is concentrated to the left guide passage 32 and concentratively discharged to the left side of the cooling chamber 10, so that the temperature of the left side of the cooling chamber 10 can be quickly dropped.

Meanwhile, when the temperature rises as a load occurs at the right side of the cooling chamber 10, as shown in FIG. 15, the control unit 74 determines that the temperature at the right side of the cooling chamber 10 has been risen according to electric signals applied from the first, second and third temperature sensors 76, 78 and 80, so that the first valve 70 is operated to shut the rear guide passage 28 and the second valve 72 is operated to the third position to shut the left guide passage 32.

Then, cooling air being supplied to the supply passage 26 is concentrated to the right guide passage 30 and discharged to the right side of the cooling chamber 10 through the right discharge duct 36, thereby quickly dropping the temperature at the right side of the cooling chamber.

As so far described, the cooling air supply apparatus of a refrigerator of the present invention has many advantages.

That is, for example, since a half of cooling air is guided from the supply passage to the rear guide passage and one-fourth of cooling air is respectively supplied to the right guide passage and the left guide passage, the cooling air distribution in the whole cooling chamber can be uniform.

In addition, when a load occurs partially as an item, or the like, is received into the cooling chamber, cooling air is concentratively discharged to the portion where the load occurs, so that a cooling operation can be quickly performed.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A cooling air supply apparatus, comprising:

a blowing fan configured to circulate air cooled while passing an evaporator of a freezing cycle;

a supply passage formed at a barrier partitioning a freezing chamber from a cooling chamber and supplying cooling air from the blowing fan to the cooling chamber;

a rear guide passage branched from the supply passage and guiding cooling air to a rear of the cooling chamber;

a right guide passage branched from the cooling air supply passage and guiding cooling air to a right side of the cooling chamber; and a left guide passage branched from the cooling air supply passage, having the same diameter as that of the right guide passage and guiding cooling air to a left side of the cooling chamber, wherein the right guide passage is formed at a right side of the barrier in a vertical direction and is configured to guide one-fourth of the cooling air supplied from the supply passage to a right discharge duct, and the left guide passage is formed at the barrier to have a certain slant angle and is configured to guide one-fourth of the cooling air supplied from the supply passage to a left discharge duct.

2. A cooling air supply apparatus of a refrigerator, comprising:

a blowing fan forcefully blowing cooling air to a freezing chamber and a cooling chamber;

a supply passage formed at a barrier partitioning the freezing chamber and the cooling chamber and supplying cooling air from the blowing fan to the cooling chamber;

a rear guide passage guiding cooling air supplied to the supply passage to a rear cooling air duct formed at a rear face of the cooling chamber;

a left guide passage guiding cooling air supplied to the supply passage to a left cooling air duct formed at a left side of the cooling chamber;

a right guide passage guiding cooling air supplied to the supply passage to a right cooling air duct formed at a right side of the cooling chamber; and a controller installed at one side of the rear guide passage and opening and closing the rear guide passage as a refrigerator door is opened and shut.

3. The apparatus of claim 2, wherein the controller comprises:

an open-and-shut valve rotatably mounted at one side of the rear guide passage and opening and closing the rear guide passage;

a door sensor configured to detect whether a cooling chamber door is opened or shut; and a controller configured to operate the open-and-shut valve to shut the rear guide passage for a predetermined time period after receiving a signal from the door sensor.

4. The apparatus of claim 3, wherein the open-and-shut valve comprises:

a disk-type valve plate rotatably mounted at one side of the rear guide passage and having the same diameter as the inner diameter of the rear guide passage; and a stepping motor connected to a rotational shaft of the valve plate and rotating the valve plate according to an electric signal of the controller.

5. The apparatus of claim 3, wherein the door sensor comprises a switch installed in the refrigerator such that when the cooling chamber door is opened, the door sensor transmits an electric signal to the controller, and when the cooling chamber door is shut, the electrical signal is no longer transmitted to the controller.

6. The apparatus of claim 3, wherein the controller includes a timer for delaying for a predetermined time period a working time of the open-and-shut valve when a signal is applied thereto from the door sensor.

7. A cooling air supply apparatus of a refrigerator comprising:

a blowing fan configured to circulate cooling air which has passed a freezing cycle to a cooling chamber and a freezing chamber;

a barrier partitioning the cooling chamber and the freezing chamber;

a supply passage formed at the barrier and supplying cooling air from the blowing fan to the cooling chamber;

a rear guide passage branched from the supply passage and configured to guide cooling air to a rear of the cooling chamber;

a right guide passage branched from the supply passage and configured to guide cooling air to a right side of the cooling chamber;

a left guide passage branched from the supply passage and configured to guide cooling air to a left side of the cooling chamber; and a cooling air controller for selectively opening and shutting the rear, left and right guide passages and concentratively discharging cooling air to a portion where a load occurs.

8. The apparatus of claim 7, wherein the cooling air controller comprises:

a sensing system configured to detect temperatures at a plurality of locations inside the cooling chamber;

a first valve installed at the rear guide passage to open and shut the rear guide passage;

a second valve installed at a point where the right and left guide passages are branched and selectively opening the right and left guide passages; and wherein the controller selectively operates the first and the second valves according to an electric signal from the sensing system.

9. The apparatus of claim 8, wherein the sensing system comprises:

a first temperature sensor installed at a rear side of the cooling chamber;

a second temperature sensor installed at a left side of the cooling chamber and detecting a temperature of the left side of the cooling chamber; and a third temperature sensor installed at a right side of the cooling chamber and detecting a temperature of the right side of the cooling chamber.

10. The apparatus of claim 8, wherein the first valve comprises:

a valve plate formed having the same diameter as that of the rear guide passage and rotatably mounted at one side of the rear guide passage; and a stepping motor connected to a hinge shaft of the valve plate and rotating the valve plate.

11. The apparatus of claim 10, wherein the second valve comprises:

a valve plate rotatably installed at a point where the supply passage is branched to the right guide passage and the left guide passage and being operated in three directions; and a stepping motor installed at a hinge shaft of the valve plate and operating the valve plate in the three directions.

12. The apparatus of claim 10, wherein the valve plate is formed in a disk type.

13. The apparatus of claim 7, wherein the rear guide passage is formed at one side of the barrier in a horizontal direction and is configured to guide half of the cooling air supplied from the supply passage to a rear discharge duct.

14. The apparatus of claim 7, wherein the right guide passage is formed at a right side of the barrier in a vertical direction and is configured to guide one-fourth of the cooling air supplied from the supply passage to a right discharge duct, and wherein the left guide passage is formed at the barrier to have a certain slant angle and is configured to guide one-fourth of the cooling air supplied from the supply passage to a left discharge duct.

15. The apparatus of claim 7, wherein the cooling air controller comprises:

an open-and-shut valve rotatably mounted at one side of the rear guide passage and opening and closing the rear guide passage;

a sensor configured to detect whether a cooling chamber door is opened or shut; and a controller configured to operate the open-and-shut valve to shut the rear guide passage for a predetermined time period after receiving an electric signal from the sensor.

16. The apparatus of claim 15, wherein the open-and-shut valve comprises:

a disk-type valve plate rotatably mounted at one side of the rear guide passage and having the same diameter as the inner diameter of the rear guide passage; and a stepping motor connected to a rotational shaft of the valve plate and rotating the valve plate according to an electric signal of the controller.

17. The apparatus of claim 15, wherein the sensor comprises a switch installed in the refrigerator such that when the cooling chamber door is opened, the sensor transmits an electric signal to the controller, and when the cooling chamber door is shut, the electric signal is no longer transmitted to the controller.

18. The apparatus of claim 15, wherein the controller includes a timer for delaying for a predetermined time period a working time of the open-and-shut valve when an electric signal is applied thereto from the sensor.

19. A cooling air supply apparatus, comprising:

a blowing fan configured to circulate air cooled while passing an evaporator of a freezing cycle;

a supply passage formed at a barrier partitioning a freezing chamber from a cooling chamber and supplying cooling air from the blowing fan to the cooling chamber;

a rear guide passage branched from the supply passage and guiding cooling air to a rear of the cooling chamber;

a rear discharge duct connected with the rear guide passage and vertically formed at the rear of the cooling chamber;

a right guide passage branched from the supply passage and guiding cooling air to a right side of the cooling chamber;

a right discharge duct connected with the right guide passage and vertically formed at the right side of the cooling chamber;

a left guide passage branched from the supply passage and guiding cooling air to a left side of the cooling chamber;

a left discharge duct connected with the left guide passage and vertically formed at the right side of the cooling chamber; and a valve plate rotatably mounted in at least one of the guide passages and the discharge ducts and adjusting cooling air volume.

* * * * *